-continued

| SELECTION MOTOR | |
|---|---|
| MOV R6,X'25' | 1. SET VARIABLE RUNS REGISTER FOR MOVE 48; |
| CALL SYSLEXPR | 1. EXECUTE 48-STEP MOVE; |
| MOV R4,X'05'<br>SYZSHSDL MOV A,131<br>CALL SYDELAY<br>DJNZ R4,SYZSHSDL | 1. POST-MOVE DELAY (50 MSEC);<br><br>(TO COUNT 50 MSEC) |
| SEL RB1<br>MOV R4,48 | 1. SET MOVE COUNTER TO 48; |
| SYZSHONE SEL RBO | 1. REPEAT |
| MOV R3,SZCT1 | 2. . LOAD COMPARE TIME REGISTER FOR MOVE 1; |
| MOV R0,SZMV1 | 2. . SET CONTROL WORD POINTER TO MOVE 1; |
| MOV A,R5<br>ANL A,SZCLRPAG<br>MOV R5,A | 2. . CLR PAGE FLAG; |
| CALL SYSLEXPR | 2. . EXECUTE 1-STEP MOVE; |
| MOV A,X'06'<br>CALL SYDELAY | 2. . POST-MOVE DELAY (20 MSEC);<br>(TO COUNT 20 MSEC) |
| SEL RB1 | 2. . DECREMENT MOVE COUNTER; |
| DJNZ R4,SYZSHONE | 1. UNTIL MOVE COUNTER = 0 |
| SEL RB0 | 1. ENDREPEAT; |
| MOV R4,X'05'<br>SYZSHEDL MOV A,131<br>CALL SYDELAY<br>DJNZ R4,SYZSHEDL | 1. POST-MOVE DELAY (50 MSEC);<br><br>(TO COUNT 50 MSEC) |
| MOV R3,SZCT3 | 1. LOAD COMPARE TIME REGISTER FOR MOVE 3; |
| MOV A,R5<br>ANL A,SZCLBDP<br>MOV R5,A | 1. SET CONTROL WORD POINTER TO MOVE 3;<br>1. SET DIRECTION TO PLUS & CLR PAGE FLAG; |
| CALL SYSLEXPR | 1. EXECUTE 3-STEP MOVE; |
| MOV A,X'06'<br>CALL SYDELAY | 1. POST-MOVE DELAY (20 MSEC);<br>(TO COUNT 20 MSEC) |
| | 1. EXIT TO DECODE ROUTINE;<br>ENDSEGMENT (SYSLHOME); |

| CARRIAGE MOTOR | |
|---|---|
| SYCHROME EQU* | |
| CALL SYPTINIT | 1. INITIALIZE PHASE TABLE; |
| MOV R5,X'E9' | 1. INITIALIZE FLAGS (DIR, EOP*, LS*, EOR* SET & NOW, CW2, VAR RESET); |
| MOV R6,SZLTAB-1 | 1. SET CONTROL WORD POINTER TO HOME PROFILE. |
| MOV R4,SZFLSTPS | 1. LOAD RUN COUNTER WITH FIRST LEVEL STEPS; |
| MOV R1,SZTHOLD<br>MOV @R1,SZFLTIME | 1. LOAD SZTHOLD WITH FIRST LEVEL TIME; |
| CALL SYNEWPHS | 1. GET FIRST PHASE & STORE IN SZPHOLD; |
| SYZCHACC EQU* | 1. REPEAT |
| CALL SYSTEP | 2. . CALL (SYSTEP) OUTPUT PHASE, LOAD & START TIMER; |
| CALL SYNXTMOV | 2. . CALL (SYNXTMOV) DETERMINE NEXT PHASE & TIME; |

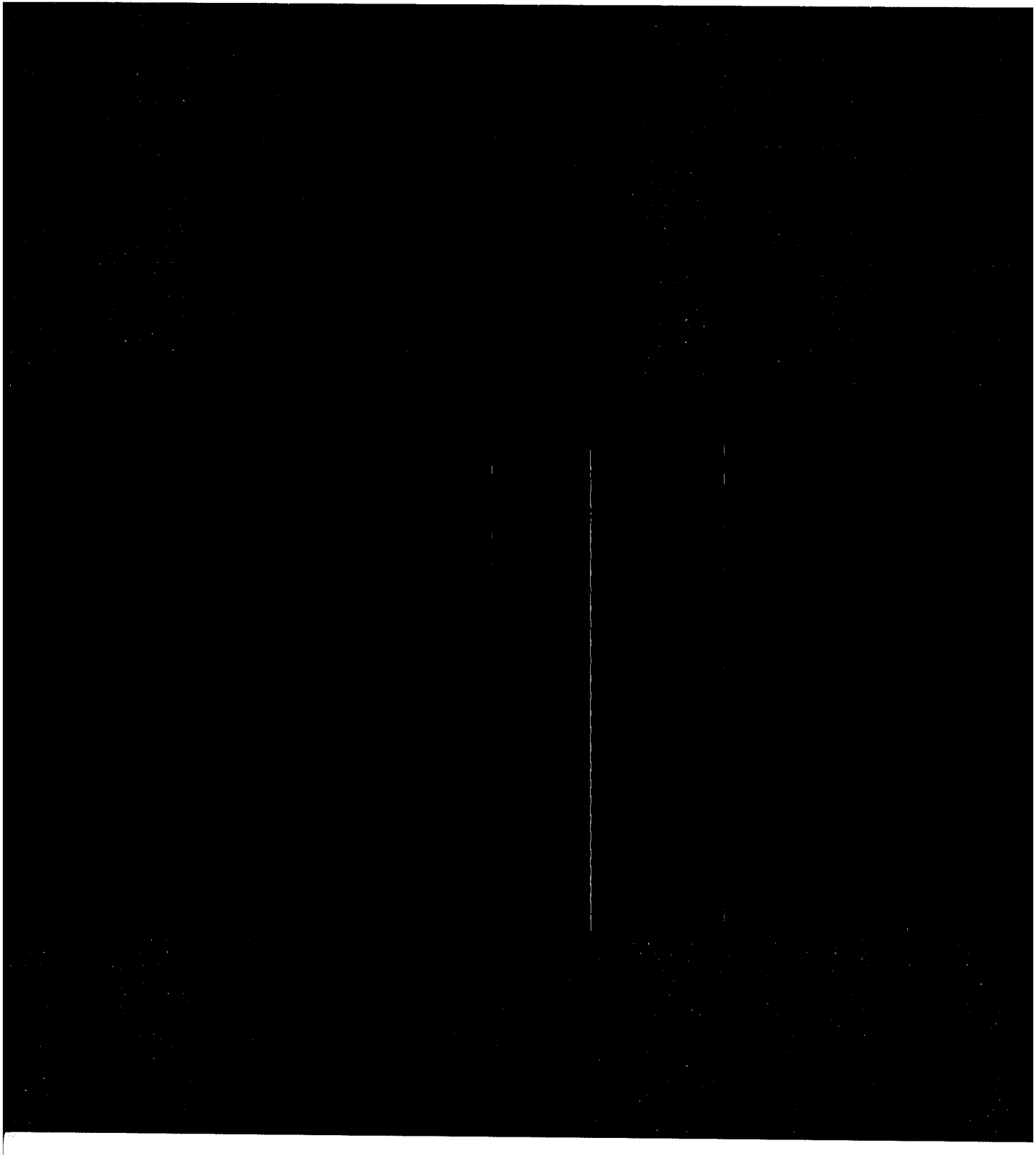

FIG. 3
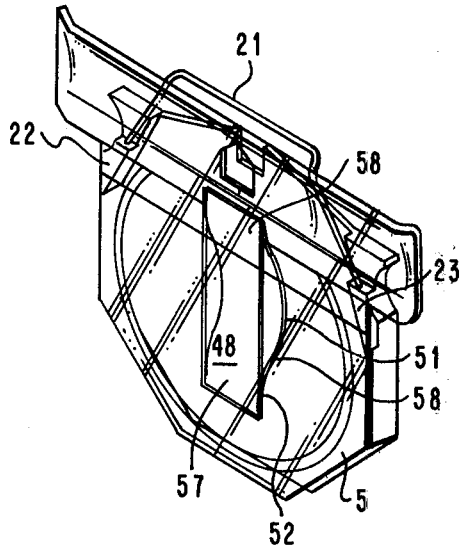
FIG. 4
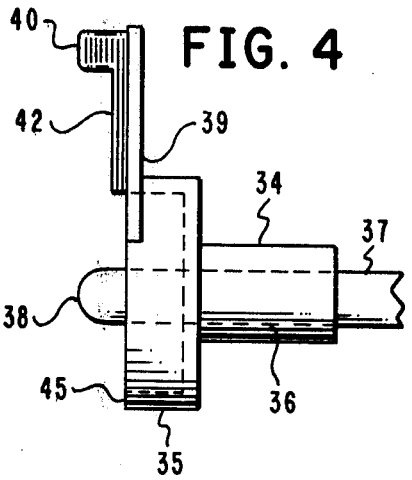
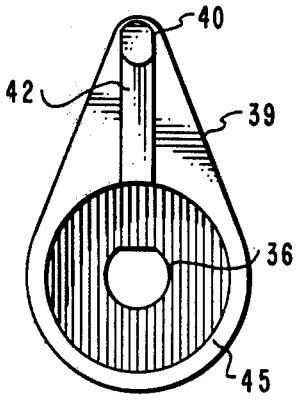
FIG. 5
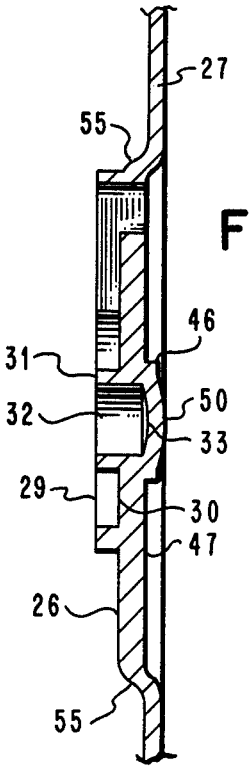
FIG. 6

PRINT ELEMENT CARTRIDGE

DESCRIPTION

CROSS-REFERENCES TO RELATED APPLICATIONS

U.S. patent application Ser. No. 968,322 filed Dec. 11, 1978, entitled "Print Element", and having A. B. Habich et al. as inventors.

U.S. patent application Ser. No. 968,320 filed Dec. 11, 1978, entitled "Print Package", and having A. B. Habich et al. as inventors.

BACKGROUND OF THE INVENTION

1. Field of the Invention

This invention generally relates to daisy wheel printers. More specifically, this invention relates to a cartridge for housing a daisy wheel print element during both storage and use in a printer.

2. Description of the Prior Art

Representing other work in this same area is U.S. patent application Ser. No. 767,250, filed Feb. 10, 1977, now U.S. Pat. No. 4,127,335, having Bogert et al. as inventors and entitled "Impact Printer With Cartridge Print Wheel". In this referenced application is disclosed a cartridge for housing a daisy wheel print element. There are a number of notable similarities between the instant and referenced applications. Both generally disclose (1) a shell within which a print element is fitted and which is to be received by a printer carrier mechanism with minimum operator intervention, (2) a generally centralized opening within the front of the shell through which access to the print element is provided for a selection motor drive hub, (3) a print hammer slot in the top of the front of the shell, and (4) a retaining leaf spring in the back of the cartridge which also serves as a bearing surface for the print element.

Several of the more important distinctions between the two applications and the advantages thereof as related to the instant application will now be addressed. To begin with, the cartridge of the instant application substantially totally encloses the print element. The only area of the print element which is readily accessible to an operator when the element is housed in the cartridge is that adjacent the centralized opening. The advantage of this is a reduced chance of soiled hands. The leaf spring in the instant application has a center bow and is oriented in the direction of insertion and removal of the print element. The centralized opening in the instant application matches an orientation protrusion on a print element and when both are in engagement, the spring serves to maintain the print element in a latched and desired rotational position for acceptance by a printer. Further, during insertion of the print element into the cartridge, the leaf spring serves as a ramp to cam the orientation protrusion toward the orientation opening. Also, the leaf spring is of a sufficient width relative to the orientation opening to prevent a print element petal from extending through the orientation opening during insertion of the element into the cartridge.

The above, as well as other distinctions and advantages of the instant application over the referenced application will be more fully appreciated when reference is made to the accompanying drawing and following description of the preferred embodiment.

SUMMARY OF THE INVENTION

A cartridge is provided for housing a daisy wheel printer print element during printing and storage. The cartridge has a front, a back, sides, and an open bottom, and is structured to substantially totally enclose the print element. The print element is made up of a central hub having character petals radially extending therefrom. Carried on one side of the central hub is an orientation protrusion extending toward the front of the cartridge when the print element is housed in the cartridge. On the other side of the central hub is a bearing protrusion. Located in the top of the front of the cartridge is a slot for accommodating a print hammer during printing. Also located in the front is a generally centralized orientation opening having the same peripheral shape as the orientation protrusion. Positioned within the cartridge and oriented in the direction of insertion and removal of the print element through the open bottom is a leaf spring having a center bow. The lower end of the leaf spring acts against the lower inside of the back and the bow is located adjacent the orientation opening and acts against the inside of the front. With this arrangement, a ramp is provided for caming the orientation protrusion toward the orientation opening during insertion of the print element into the cartridge. When the orientation protrusion is aligned with the orientation opening, the spring serves to cause engagement of the opening and protrusion for latching the print element in a desired rotational position. During printing, the orientation protrusion is out of engagement with the orientation opening and the print element is located intermediate the front and back of the cartridge. Upon rotation of the print element for character selection during printing, the bearing protrusion is acting against the spring which now serves as a bearing surface. Also forming part of the cartridge are a card holder connected to the top of the back and a ribbon guide connected to the top of the front. Thus, a total module is provided for better facilitating print element changes and printing, and significantly reducing printer carrier clutter.

BRIEF DESCRIPTION OF THE DRAWING

FIG. 1 is a front perspective view of a print package including the cartridge of this invention with the print element removed. Also illustrated is a selection motor drive hub for causing rotation of the print element.

FIG. 2 is a rear perspective view of the print element shown in FIG. 1.

FIG. 3 is a rear perspective view of the cartridge shown in FIG. 1.

FIG. 4 is a side view of the drive hub illustrated in FIG. 1.

FIG. 5 is a front face view of the drive hub illustrated in FIG. 1.

FIG. 6 is a vertical diameter cross-sectional view of the print element shown in FIGS. 1 and 2.

DESCRIPTION OF THE PREFERRED EMBODIMENT

For a detailed understanding of the invention, reference is first made to FIG. 1. In this figure there is shown a cartridge generally designated by reference numeral 1, a daisy wheel printer print element generally designated by reference numeral 2, and a selection motor drive hub generally designated by reference numeral 3. Cartridge 1 is the subject of this invention. During actual printing operations, cartridge 1 having print element 2 included therein is inserted into an accepting printer including drive hub 3 for rotating element 2.

Before further discussing cartridge 1 and its relationship to print element 2 and drive hub 3, the following additional background information is deemed in order. In a normal daisy wheel printer arrangement, the mounting of a daisy wheel print element on a selection motor drive hub requires substantial operator interaction in terms of apparatus manipulation. Also, the mounting apparatus is often elaborate. For example, in one common embodiment a knob is secured to the center of the printing side of the print element to provide an operator with a handle. On the opposite side of the print element is an opening for accepting a selection motor drive shaft or hub. The operator procedure is to grasp the print element knob, rotationally orient the print element, and then force the print element onto the drive shaft. Forcing is required since there is a press or interference fit between the print element opening and the drive hub. Prior to this operation though, the motor must be withdrawn or tilted to provide sufficient room in, or closely adjacent, the print mechanism area for an operator to change or install the print element. Even at this, space is not abundant and the chance of soiled hands is great. After both operations have been completed, the mere handling of the removed print element often results in soiled hands.

The cartridge of this invention is structured to house a print element and be removeably carried by a printer carrier in such a manner as to substantially minimize the above noted problems. Ignoring motor withdrawal which is improved in a manner to be described in a later copending application, working space is not a consideration. This is since the cartridge having a print element included therein is adapted to be vertically inserted into an accepting printer from a substantially unobstructed location exterior of the limited space print mechanism area. Also, since the print element is substantially totally enclosed in the cartridge, the mere changing of the package for a print element change all but eliminates the possibility of soiled hands.

With the above in mind, reference is again made to FIG. 1 and specifically to cartridge 1. Cartridge 1 is essentially made up of a shell 4 and a back cover 5. Shell 4 has a front 6 having an orientation opening 7 and a print hammer slot 8. Front 6 faces a print mechanism including a selection motor and a print hammer carried by a printer carrier. Slot 8 is for accommodating the print hammer which is used in a well known manner to facilitate printing. Orientation opening 7 is somewhat arrowhead in shape and generally centralized within front 6. Opening 7 is for cooperating with print element 2 to maintain print element 2 properly oriented during non-use as will be described later herein. Integral with front 4 are sides 9 and 10. Sides 9 and 10 have recesses 11 and 12, respectively, which accommodate an operator's thumb and finger for grasping cartridge 1. The lower portion of front 6 has converging tapered edges 13 and 14 which terminate with bottom edge 15. Shell 4 has no side walls along either tapered edges 13 and 14 or bottom edge 15. The outer periphery of back 5 is symmetrical with the periphery of front 6 from recesses 11 and 12 of sides 9 and 10 to bottom 15. Thus, when shell 4 is connected to back 5, cartridge 1 is provided with an open bottom which serves as a loading opening for the insertion and removal of print element 2.

Tapered edges 13 and 14 and the matching portion of back 5 serve two useful purposes. One is that the corners thus eliminated reduce the mass of the cartridge which is carried by a printer carrier during printing operations. The other is that guides are provided for inserting the cartridge into an accepting receptacle on the carrier.

The upper portion of shell 4 has ramps 16 and 17 which extend from adjacent recesses 11 and 12 to near the top center of shell 4 and terminate in slot 8. Slot 8 has sides 18 and 19 and a bottom 20. Slot 8 is large enough to permit clear passage of a print hammer during printing, yet small enough to reduce the chances of an operator having thumb or finger access to print element 2. That is, operator access to print element 2 is restricted by the size of slot 8. Ramps 16 and 17 are to provide enclosure of the upper portion of print element 2 when housed in cartridge 1, and permit as much operator writing line viewing as possible.

Shell 4 carries ribbon guide 21 which can be made up of a metallic wire rod shaped as shown. Referring for a moment to FIG. 3, the interior of shell 4 has integral internal abutments 22 and 23 having openings therein for accepting the ends of ribbon guide 21. Ribbon guide 21 is for guiding a typewriter ribbon in lifted and lowered positions relative to slot 8 during printing.

A cardholder 24 is carried on the upper end of back 5 as an integral portion thereof. Horizontally centered within cardholder 24 is a type opening 25 which is generally aligned with slot 8. The requirements for the dimensions of opening 25 and slot 8 are somewhat different. That is, opening 25 must be (1) located such that it can be properly aligned with a printer platen, and (2) of sufficient width when on-the-fly printing is considered to permit rebound of a print element petal in time to avoid contact with a side of opening 25. While accommodating these requirements, opening 25 is also to be small enough to restrict operator access to print element 2. Also, front 6 and back 5 are spaced sufficiently close together to restrict operator access through either the top or bottom of cartridge 1. Therefore, when print element 2 is housed in cartridge 1, the only area of print element 2 readily contactable by an operator during normal handling of cartridge 1 is that accessible through opening 7.

Reference is still to FIG. 1 and now specifically print element 2. As pointed out above, element 2 is to be housed and rotated within cartridge 1 during printing operations. Element 2 is located intermediate the insides of front 6 and back 5 during rotation thereof. Print element 2 is generally daisy wheel in shape and has a central hub 26. Connected to hub 26 are radially extending petals 27. Adjacent the outer extremities of petals 27 are types or character slugs 28 which are utilized in a printing process in a well known manner. Types 28 on petals 27 are located on the printing side of element 2. The opposite side of element 2 is the impact side. On the impact side, petals 27 are structured to be impacted by a print hammer. Referring also to FIGS. 2 and 6, central hub 26 is circular and generally dish shaped in that it has a flanged periphery 55 to which are connected petals 27. Hub 26 carries orientation protrusion 29 on its protruding side as shown. Thus, protrusion 29 is on the impact side of element 2. Protrusion 29 engulfs the axis of rotation of element 2, and has a peripheral arrowhead shape corresponding to opening 7 in cartridge 1. Stated alternatively. opening 7 is a matching opening for protrusion 29. The arrowhead shapes of protrusion 29 and opening 7 are symmetrical with respect to a radius extending vertically and perpendicularly from the axis of rotation of print element 2. When considered relative to the axis of rotation of print element 2 for rotational orientation purposes though, these shapes are both asymmetrical, and insure one desired orientation of element 2 within cartridge 1. That is, when protrusion 29 is in engagement with opening 7, print element 2 is latched, as defined later herein, in only a single rotational position.

Within protrusion 29 is a skillet shaped depression 30 also engulfing the axis of rotation of element 2 and having the protruding side of hub 26 as a bottom. Within depression 30 is a cylindrical extension 31 having an opening 32. Opening 32 is axially aligned with the axis of rotation of element 2, and has a bottom 33 below the bottom of depression 30. Opening 32 is for accepting a selection motor drive shaft which extends through hub 3 for centering, and preventing wobble of, element 2 as will be described in greater detail later herein.

Reference is now made specifically to drive hub 3 illustrated in FIGS. 1, 4 and 5. Drive hub 3 is made up of a cylinder 34 connected to a cupped flange 35. Axially centered within cylinder 34 and flange 35 is D-shaped opening 36 extending therethrough. Opening 36 is for accepting a matching selection motor drive shaft 37 having a D-shaped cross-section. D-shaped opening 36 insures a positive rotational connection between shaft 37 and hub 3. Hub 3 is connected along shaft 37 as shown, and may be bonded thereto. If the fit between shaft 37 and opening 32 is sufficiently close, opening 32 is relatively deep, and shaft 37 extends relatively far into opening 32, element 2 is stabilized in a radial direction perpendicular to the axis of rotation of element 2 and shaft 37. That is, any tendency for element 2 to wobble is significantly reduced. Since front 6 and back 5 are to be closely spaced, any wobble of print element 2 on shaft 37 would be particularly undesirable from wear, breakage and free rotation standpoints.

Carried on the periphery of flange 35 is radially extending arm 39. Adjacent the outer end of arm 39 is drive pin 40 structured to communicate with opening 41 (FIG. 2) in element 2. Opening 41 is located in the end of handle 43 of skillet shaped depression 30 and extends through element 2. Pin 40, when inserted into opening 41, is utilized to cause element 2 to rotate upon rotation of shaft 37. Pin 40 and opening 41 have similar peripheries. That is, both have flat sides and arcuate ends.

The width of opening 41 is only slightly larger than the width of pin 40. This is to reduce play between element 2 and hub 3 during rotation of element 2 by hub 3. To accommodate varying tolerances though, the length of opening 41 is somewhat greater than the length of pin 40. Therefore, with the overall size of opening 41 being greater than pin 40, the flat sides provide sufficient driving contact areas to reduce wear and indentation problems. Added support for arm 39 is provided by rib 42. Handle 43 is sufficiently wide to freely accept rib 42.

The outer periphery of flange 35 is greater in diameter than the inner periphery 44 of depression 30. As such, face 45 of flange 35 abuts the face of protrusion 29 for radially aligning and stabilizing element 2 to further aid in reducing print element wobble. A flush fit between face 45 and the stabilizing face of protrusion 29 is aided by spring 48 which urges element 2 toward hub 3. The part played by spring 48 will be more fully discussed later in the specification. An important point to note at this time is that hub 3 is not to be displaced from end 38 of shaft 37 sufficiently for end 38 to completely bottom in opening 32 of element 2. Otherwise, a complete mating of face 45 and the face of protrusion 29 may be prevented. Also, even though the outer periphery of flange 35 is greater than the inner periphery 44, flange 35 is still small enough for hub 3 to be freely passed through opening 7 when properly orientated relative to print element 2 when print element 2 is latched in cartridge 1.

The reason for the pan portion of skillet shaped depression 30 is to reduce the mass of element 2. In like manner, flange 35 is cup shaped to reduce mass. Any reduction is mass results in improved response time in starting and stopping rotation of element 2.

Refer next to FIGS. 2 and 6. In these figures is shown the back or printing side 56 of print element 2. Carried on back 56 is a protruding bearing stud 46 centered within the dished side 47 of central hub 26. Stud 46 extends beyond the dish and is adapted to communicate with spring 48 located in cartridge 1 shown in FIG. 1. Stud 46 is made up of a cylinder 49 carrying a bullet extension 50 having an arcuate cross-section. Bullet 50 acts as a bearing for element 2 against spring 48 during rotation of element 2. Spring 48 in turn acts as a bearing surface for bullet 50. When element 2 is housed in cartridge 1 and not being utilized in a printing process, spring 48 provides a thrust against bullet 50 to bias and maintain element 2 latched in cartridge 1.

Before further discussing the relationship of element 2 and spring 48, several specific details of spring 48 and cartridge 1 will be brought out. Referring to FIG. 3, spring 48 is a leaf spring having a bowed center portion 51 extending toward and located adjacent opening 7. In fact, front 6 and back 5 are spaced, and spring 48 is bowed, such that portion 51 acts against the inside of front 6. Back 5 has an inside rectangular depression 52 for accepting and aiding in retaining spring 48 in a desired position relative to opening 7. That is, spring 48 is to be held in place and remain properly oriented both when bowed as shown and when somewhat extended during the time element 2 is located within cartridge 1 and between spring 48 and front 6. Ends 57 and 58 are located in depression 52 and act against the inside of back 5. Depression 52 is sufficiently long to accommodate spring 48 when extended. Spring 48 is sufficiently long to provide a gradual ramp. Ends 57 and 58 are maintained in depression 52 by front 6 acting against bow 51. Thus, the orientation and length of spring 48, and the extent of bow 51 are such that spring 48 serves as a ramp for bullet 50 of element 2 for camming protrusion 29 toward opening 7 during insertion of element 2 into cartridge 1.

When element 2 is inserted into cartridge 1 from the bottom of cartridge 1, the force of spring 48 must be overcome. As alluded to above, this is because of the proximity of the insides of back 5 and front 6 and the bowed portion 51 acting against the inside of front 6 adjacent opening 7. During insertion of element 2 into cartridge 1, bullet 50 will ride up bow 51. With end 57 seated in depression 52, there will be no snagging of bullet 50 on end 57. When protrusion 29 and opening 7 are aligned, spring 48 will urge and cam protrusion 29 into opening 7 for engagement therewith. Upon engagement of protrusion 29 and opening 7, element 2 is latched in a properly oriented or desired rotational position within cartridge 1. At this time, the print package made up of element 2 and cartridge 1 is available for either printing use or non-use. For printing use, the print package is inserted into an accepting printer. For printing non-use, the print package can be stored, shipped, etc.

Referring again to the relationship of spring 48 and element 2, the width of spring 48 is of great importance when a print element is to be inserted into an empty cartridge. The horizontal width of spring 48 must be sufficient to eliminate the possibility of a print element petal 27 extending through opening 7 during insertion of element 2 into cartridge 1. If spring 48 is made relatively narrow compared to opening 7, a few petals will be forced out of the plane of the remaining petals. To eliminate this possibility, spring 48 in the illustrated embodiment is made wider than opening 7. This results in all petals adjacent opening 7 remaining in the same plane. The vertical orientation of spring 48 is also important relative to petals 27. That is, since petals 27 are radially extending, there will be no snagging on spring 48 if vertically oriented.

When pring element 2 is to be used for printing, cartridge 1 having element 2 latched therein is inserted into an accepting hopper in a daisy wheel printer. Thereafter, drive hub 3 and attached selection motor and shaft are translated toward central hub 26. Shaft 37 will mate with opening 32, pin 40 will mate with opening 41, and face 45 will contact the face of protuberance 29. Further translation of hub 3 in the same direction will result in bullet 50 of element 2 causing ends 57 and 58 of spring 48 to extend in the vertical direction. Ultimately, protrusion 29 will clear opening 7 and element 2 will be unlatched for rotation within cartridge 1. During rotation of element 2 for selection and printing, arm 39 and pin 40 will be located within cartridge 1 and spring 48 will act as a bearing surface for bullet 50.

Referring again to print element 2 in FIGS. 1, 2, and 6, the dish shaped central hub 26 has a number of advantages. One is that due to the structural arrangement disclosed, print element 2 taken as a whole can be made relatively thin and still resist warp. In fact, the thickness of central hub 26, excluding protuberance 29 and stud 46, can be essentially the same as the overall thickness of element 2. Another is that protuberance 29 is brought closer to orientation opening 7. This reduces the chances of interference between the remainder of print element 2 and cartridge 1. Further, due to the relationship of the bow in leaf spring 48 to stud 46, the remainder of print element 2 is spaced from the greater part of spring 48 during rotation of element 2.

For removal of print element 2 from cartridge 1, the operator procedure is to contact protrusion 29 with a thumb and then press in and down. This action results in an unlatching of print element 2 and a downward displacement thereof. If the lower outer periphery of element 2 is relatively close to bottom 15 when element 2 is latched in cartridge 1, very little downward displacement of element 2 is required to supply a sufficient area of element 2 for an operator to grasp. To avoid soiled hands, the operator can simply use a tissue when grasping element 2.

In summary, a cartridge is provided for housing a daisy wheel printer print element during printing and storage. The cartridge has a front, a back, sides, and an open bottom, and is structured to substantially totally enclose the print element. The print element is made up of a central hub having character petals radially extending therefrom. Carried on one side of the central hub is an orientation protrusion extending toward the front of the cartridge when the print element is housed in the cartridge. On the other side of the central hub is a bearing protrusion. Located in the top of the front of the cartridge is a slot for accommodating a print hammer during printing. Also located in the front is a generally centralized orientation opening having the same peripheral shape as the orientation protrusion. Positioned within the cartridge and oriented in the direction of insertion and removal of the print element through the open bottom is a leaf spring having a center bow. The lower end of the leaf spring acts against the lower inside of the back and the bow is located adjacent the orientation opening and acts against the inside of the front. With this arrangement, a ramp is provided for caming the orientation protrusion toward the orientation opening during insertion of the print element into the cartridge. When the orientation protrusion is aligned with the orientation opening, the spring serves to cause engagement of the opening and protrusion for latching the print element in a desired rotational position. During printing, the orientation protrusion is out of engagement with the orientation opening and the print element is located intermediate the front and back of the cartridge. Upon rotation of the print element for character selection during printing, the bearing protrusion is acting against the spring which now serves as a bearing surface. Also forming part of the cartridge are a card holder connected to the top of the back and a ribbon guide connected to the top of the front. Thus, a total module is provided for better facilitating print element changes and printing, and significantly reducing printer carrier clutter.

While the invention has been particularly shown and described with reference to a particular embodiment, it will be understood by those skilled in the art that various changes in form and detail may be made without departing from the spirit and scope of the invention.

What is claimed is:

1. A cartridge for a daisy wheel printer print element having a central hub carrying an orientation protrusion thereon, said cartridge comprising in combination;

(a) a shell having a front and sides, said front having an orientation opening therein, said orientation opening being asymmetrical in shape with respect to the axis of rotation of said print element, having a periphery matching a periphery of said orientation protrusion, and being shaped such that when said orientation opening and protrusion are in engagement, said print element is maintained in one one rotational position within said cartridge;

(b) a back connected to said sides to form a substantially enclosed housing having a loading opening in the bottom thereof, said back including retaining means inside said cartridge;

(c) a biasing member located inside said cartridge and extending toward said orientation opening, said retaining means being for retaining said biasing member.

2. In a cartridge for a daisy wheel print element having an orientation protrusion engulfing the axis of rotation of said print element, said cartridge having a front, a back, sides, and an open bottom, wherein the improvement comprises:

an orientation opening which (1) is located in said front, (2) has a periphery which is asymmetrical with respect to said axis of rotation, and (3) insures a single rotational position of said element when said orientation protrusion is in engagement with said orientation opening.

3. A cartridge according to claim 1 wherein said biasing member is a leaf spring extending toward said orientation opening.

4. A cartridge according to claim 3 wherein said leaf spring is bowed with the bow extending toward said orientation opening and the ends of said leaf spring extending toward said back.

5. A cartridge according to claim 4 wherein said back includes retaining means for cooperating with said ends of said leaf spring.

6. A cartridge according to claim 5 wherein said retaining means is a depression in said back.

7. A cartridge according to claim 6 wherein said depression is of a sufficient size to permit extension of said leaf spring upon translation of said ends of said leaf spring.

8. A cartridge according to claim 7 wherein said front and back are spaced such that the inside of said front acts against said bow in said leaf spring to maintain said ends of said leaf spring in said depression.

9. A cartridge according to claim 8 wherein said leaf spring is wider than said orientation opening.

10. A cartridge according to claim 9 wherein said leaf spring is longer than said orientation opening.

11. A cartridge according to claim 2 including a ribbon guide connected to said cartridge adjacent the top thereof.

12. A cartridge according to claim 2 including a card holder connected to said cartridge adjacent the top thereof.

13. A cartridge according to claim 2 including a biasing member positioned within said cartridge between said front and said back and located adjacent said orientation opening.

14. In a cartridge for housing a print element which is rotatable within said cartridge for printing and which includes orientation means, wherein the improvement comprises an orientation opening (1) engageable with said orientation means, and (2) shaped such that when said orientation opening and said orientation means are in engagement, said print element will be latched in one rotational position against rotation until unlatched upon disengagement of said orientation means and said orientation opening for rotation within said cartridge during printing.

15. A cartridge for a print element which is rotatable within said cartridge during printing and which includes orientation means, said cartridge comprising in combination:

(a) a front and a back making up a housing for said print element; and (b) orientation means located in said housing for cooperating with said orientation means of said print element, said orientation means of said housing being structured for engagement and disengagement with said orientation means of said print element such that (1) upon engagement, said print element is latched in one rotational position against rotation, and (2) upon disengagement, said print element is unlatched for rotation within said cartridge for printing.

* * * * *